US007549886B2

(12) United States Patent
Herring et al.

(10) Patent No.: US 7,549,886 B2
(45) Date of Patent: Jun. 23, 2009

(54) REMOTE BLIND MATE CONNECTOR RELEASE SYSTEM FOR A SCALABLE DEEP PLUG CABLE

(75) Inventors: Dean Frederick Herring, Youngsville, NC (US); Paul Andrew Wormsbecher, Apex, NC (US)

(73) Assignee: International Business Machines Corporation, Armonk, NY (US)

( * ) Notice: Subject to any disclaimer, the term of this patent is extended or adjusted under 35 U.S.C. 154(b) by 140 days.

(21) Appl. No.: 11/834,225

(22) Filed: Aug. 6, 2007

(65) Prior Publication Data

US 2009/0042431 A1 Feb. 12, 2009

(51) Int. Cl.
*H01R 13/627* (2006.01)

(52) U.S. Cl. ..... 439/352

(58) Field of Classification Search ..... 439/350–358
See application file for complete search history.

(56) References Cited

U.S. PATENT DOCUMENTS

| | | | | |
|---|---|---|---|---|
| 6,430,053 | B1 | 8/2002 | Peterson et al. | |
| 6,920,275 | B2 * | 7/2005 | Chamorro et al. | 385/137 |
| 7,090,523 | B2 | 8/2006 | Shirk et al. | |
| 7,134,914 | B1 * | 11/2006 | Wu | 439/610 |
| 7,147,502 | B1 * | 12/2006 | Wu | 439/352 |
| 7,156,683 | B2 | 1/2007 | Gupta et al. | |
| 7,186,134 | B2 | 3/2007 | Togami et al. | |
| 7,226,316 | B2 * | 6/2007 | Wu | 439/610 |
| 7,238,040 | B1 * | 7/2007 | Wu | 439/352 |
| 7,281,937 | B2 * | 10/2007 | Reed et al. | 439/352 |
| 7,281,938 | B1 * | 10/2007 | Wu | 439/353 |
| 7,318,740 | B1 * | 1/2008 | Henry et al. | 439/352 |
| 7,354,292 | B1 * | 4/2008 | Lloyd et al. | 439/352 |
| 7,384,299 | B1 * | 6/2008 | Bridges et al. | 439/445 |
| 2004/0121643 | A1 * | 6/2004 | Roth et al. | 439/352 |
| 2005/0075001 | A1 * | 4/2005 | Shearman et al. | 439/352 |
| 2006/0189197 | A1 * | 8/2006 | Reed et al. | 439/352 |
| 2007/0161281 | A1 * | 7/2007 | Wu | 439/352 |
| 2007/0232118 | A1 * | 10/2007 | Wu | 439/353 |
| 2007/0243749 | A1 * | 10/2007 | Wu | 439/352 |
| 2008/0032541 | A1 * | 2/2008 | Reed et al. | 439/352 |

* cited by examiner

*Primary Examiner*—Ross N Gushi
(74) *Attorney, Agent, or Firm*—Cynthia G. Seal; Jeffrey L. Streets

(57) ABSTRACT

A cable trough comprising a rigid trough securing a cable that terminates with a cable connector plug. The cable connector plug has a connector latch operable with a pull tab for selectively latching the cable connector plug to a blind mate connector inside an electronic device. The trough secures the connector plug in axial alignment with the trough and includes a release lever pivotally coupled to the proximal end of the trough. An elongate wire extends within the trough and is coupled between the release lever and the pull tab. Accordingly, the rigid trough may be directed into a guide passage aligned with the blind mate connector for coupling and latching of the connector plug to the blind mate connector. The release lever is pivotally operable to pull the wire and actuate the pull tab to release the connector latch.

14 Claims, 3 Drawing Sheets

REMOTE BLIND MATE CONNECTOR RELEASE SYSTEM FOR A SCALABLE DEEP PLUG CABLE

BACKGROUND OF THE INVENTION

1. Field of the Invention

The present invention relates to the use of scalable deep plug cables to interconnect computer hardware. More specifically, the present invention is an apparatus for coupling a scalable deep plug cable to a blind mate connector.

2. Description of the Related Art

Computer systems have many component parts designed to operate cooperatively and there are various types of connections between the component parts that may be required. For example, server systems will often have several electronic circuit boards that each has electronic components, including a processor, that perform operations in communication with each other. While an electronic circuit board may be connected directly to a connector on a second electronic circuit board, electronic circuit boards are often connected with cables that allow communication there between.

The scalability of certain types of computer systems, including blade servers, facilitates the addition of new components or the reconfiguration of existing components in a data center. Scalability, however, relies upon the ability to interconnect multiple chassis via cables. This interconnection can be complicated due to the fact that the chassis that house blade servers or other computer system components are often configured very close to each other in order to conserve space in a data center environment. Furthermore, even the components within the chassis are very tightly configured to provide a high component density. In fact, some computer components may be positioned in such a manner within a chassis that reaching a desired connector is difficult without removal of numerous components from the chassis.

Some systems that contain difficult to reach components may include a cable interposer, or a run of cable that is connected to a difficult to reach component in order to provide a connector that is more readily accessible. However, the usage of a cable interposer adds undesirable signal losses and a cable connected deep within the chassis will have a latch at the connector that is unreachable by the user.

Still, high speed performance is a critical factor in some computer systems. Therefore, it is desirable to configure components for optimum communication and operational speed. Long runs of communication cable between components can cause signal losses or lags in performance. Consequently, it is often desirable to minimize the length of cable between components in order to optimize performance.

Therefore, there is a need for an apparatus to facilitate a deep plug cable connection with a difficult to reach component having a bind mate connector. It would be desirable if the apparatus also facilitated latching and unlatching of the cable without removal of adjacent components. Furthermore, it would be even more desirable if the apparatus did not require a redesign of exiting scalable cables or connectors for receiving the cables.

SUMMARY OF THE INVENTION

One embodiment of the present invention provides a cable trough comprising a rigid trough securing a cable that terminates with a cable connector plug, wherein the cable connector plug has a connector latch operable with a pull tab for selectively latching the cable connector plug to a blind mate connector inside an electronic device. The trough has a distal end securing the cable connector plug in axial alignment with the trough, a proximal end, and an elongate trough section extending between the proximal and distal ends. The cable trough also includes a release lever pivotally coupled to the proximal end of the trough. An elongate wire extends within the trough and has a first end coupled to the release lever and a second end coupled to the pull tab. Accordingly, the rigid trough may be directed into a guide passage aligned with the blind mate connector for coupling and latching of the cable connector plug to the blind mate connector. The release lever is pivotally operable to pull the wire and actuate the pull tab to release the connector latch. Preferably, the release lever extends beyond a proximal end of the guide passage for accessible operability when the cable connector plug is latched to the blind mate connector. The release lever may form a rocker arm.

Another embodiment of the present invention provides an apparatus comprising a cable and a rigid trough securing the cable. The cable terminates with a cable connector plug having a connector latch operable with a pull tab for selectively latching the cable connector plug to a blind mate connector inside an electronic device. The rigid trough has a distal end securing the cable connector plug in axial alignment with the trough, a proximal end, and an elongate trough section extending between the proximal and distal ends. The rigid trough also includes a release lever pivotally coupled to the proximal end of the trough. An elongate wire extends within the trough and has a first end coupled to the release lever and a second end coupled to the pull tab. Accordingly, the rigid trough may be directed into a guide passage aligned with the blind mate connector for coupling and latching of the cable connector plug to the blind mate connector. The release lever is pivotally operable to pull the wire and actuate the pull tab to release the connector latch. Preferably, the release lever extends beyond a proximal end of the guide passage for accessible operability when the cable connector plug is latched to the blind mate connector. The release lever may form a rocker arm.

DETAILED DESCRIPTION OF PREFERRED EMBODIMENTS

Figure 1:
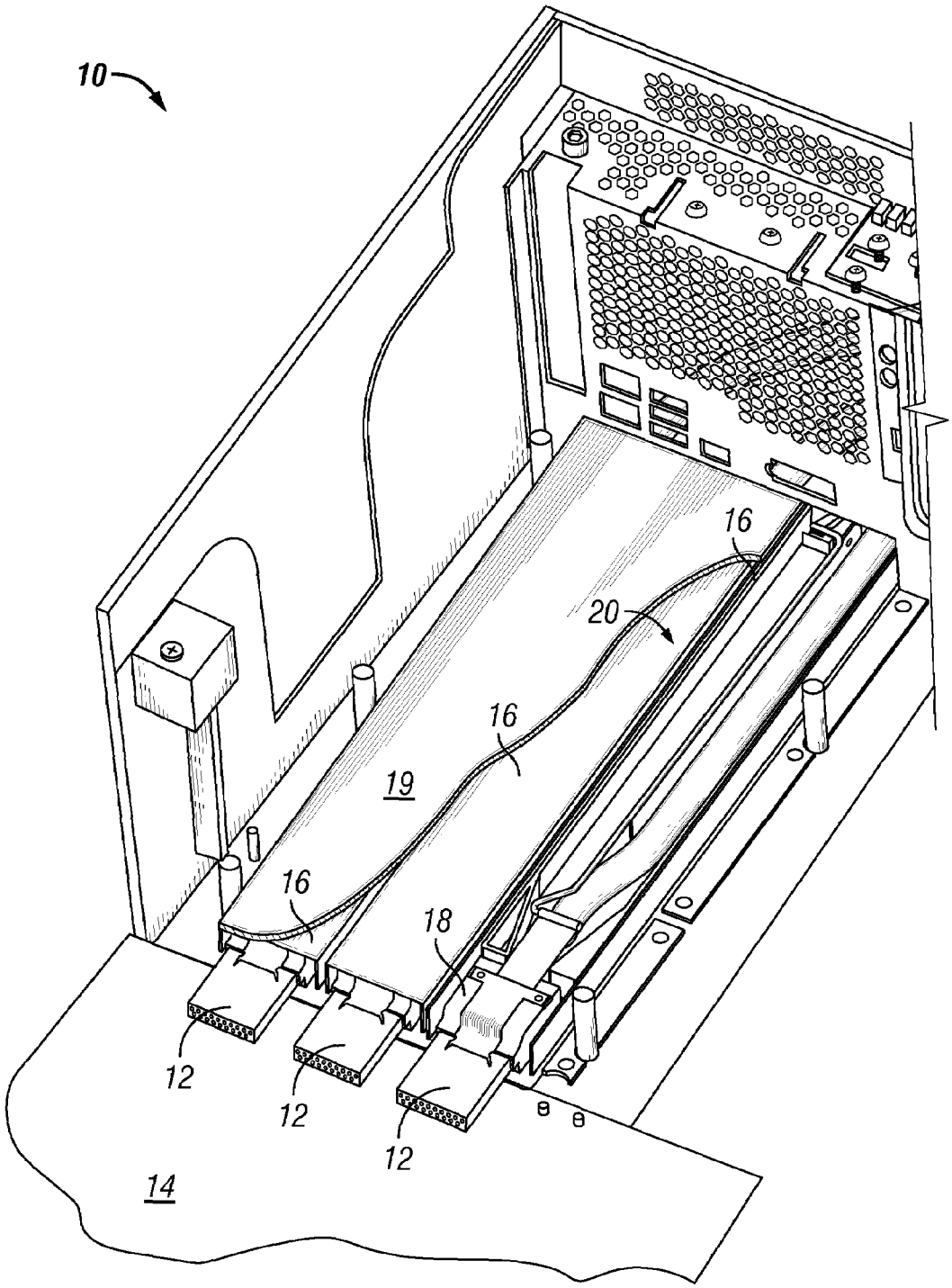
FIG. 1 is a perspective view of a computer chassis have blind mate connectors on a motherboard, guide channels aligned with the blind mate connectors, and a cable trough inserted in one of the guide channels for connection of a cable connector plug with a blind mate connector.

One embodiment of the present invention provides a cable trough comprising a rigid trough securing a cable that terminates with a cable connector plug, wherein the cable connector plug has a connector latch operable with a pull tab for selectively latching the cable connector plug to a blind mate connector inside an electronic device. The cable may include one or more electronic conductors in various configurations and coupled to various types of connectors. However, the cable trough is preferably suitable for use with a scalability cable, such as a MOLEX iPASS™ interconnect system cable (a trademark of Molex of Lisle, Ill.).

The rigid trough has a distal end securing the cable connector plug in axial alignment with the trough. The cable connector plug may be secured with various fastener configurations and may include both permanent and temporary fasteners. Preferably, the cable connector has a pair of mounting holes on the proximal end of the connector on either side of the cable. The mounting holes on the cable connector preferably cooperate with mounting holes on the distal end of the rigid trough to enable the cable connector to be secured with one or more pins or screws. The rigid trough also an elongate trough section extending between a proximal and distal ends.

The cable trough also includes a release lever pivotally coupled to the proximal end of the trough. An elongate wire extends along the trough and has a first end coupled to the release lever and a second end coupled to the pull tab. The release lever is pivotally operable to pull the wire and actuate the pull tab to release the connector latch. Preferably, the release lever extends beyond a proximal end of the guide passage for accessible operability when the cable connector plug is latched to the blind mate connector. Although the release lever may take various forms and configurations, the lever preferably facilitates easy and accessible operation of one end of the lever, while providing a generally axial displacement of the elongate wire. A particularly preferred release lever forms a rocker arm, such that a downward force on a proximally extending arm causes the proximal displacement of the wire. For example, the two arms of the lever may be at about a right angle relative to the pivot point. Such a lever might also be referred to as a cam. A particular advantage of such a rocker arm is that the latch is released with a downward force, rather than a rearward pulling force, so that there is no rearward force being applied to the latch element while trying to release the latch element. This is especially important when the latch element is a curved hook designed to prevent the connector plug from pulling loose from the blind mate connector, such that any rearward forces can inhibit the hook from releasing.

Accordingly, the rigid trough may be directed into a guide passage aligned with the blind mate connector for coupling and latching of the cable connector plug to the blind mate connector. The guide passage slidably receives the trough and is positioned in a manner to align the cable connector plug and the blind mate connector when the cable trough is inserted within the guide passage. Typically, the guide passage forms a part of a chassis.

In a preferred embodiment, the rigid trough secures the cable along a first side of the elongate trough section and the elongate wire extends along a second side of the elongate trough section. The first and second sides are preferably separated by a dividing wall to prevent interference between the cable and the elongate wire. Furthermore, the trough is substantially open along one wall, such as a top, to receive the cable and couple the wire to the pull tab.

Another embodiment of the present invention provides an apparatus comprising a cable permanently integrated with a rigid trough. Accordingly, the cable connector may be secured with rivets or other generally permanent fasteners, and the rigid trough may be more or less enclosed since the cable and elongate wire are both permanently received.

FIG. 1 is a perspective view of a portion of a computer chassis 10 have three blind mate connectors 12 on a motherboard 14, three guide channels 16 aligned with the blind mate connectors 12, and a cable trough 20 inserted in one of the guide channels 16 for connection of a cable connector plug 18 with one of the blind mate connectors 12. The computer chassis 10 would ordinarily include components above the top wall 19 of the guide channels 16, such as a second mother board, but these components have been removed to reveal the location of the guide channels 16. Furthermore, the top wall 19 of the guide channels 16 has been partially cut away to show the individual guide channels 16 and a cable trough 20 positioned in one of the channels. In an actual installation, the blind mate connectors 12 are difficult to access and connecting them with a cable connector plug can require physical removal of numerous components from the chassis 10. However, the use of a cable trough and a guide channel allows the connection to be made without removing components from the chassis.

Figure 2:
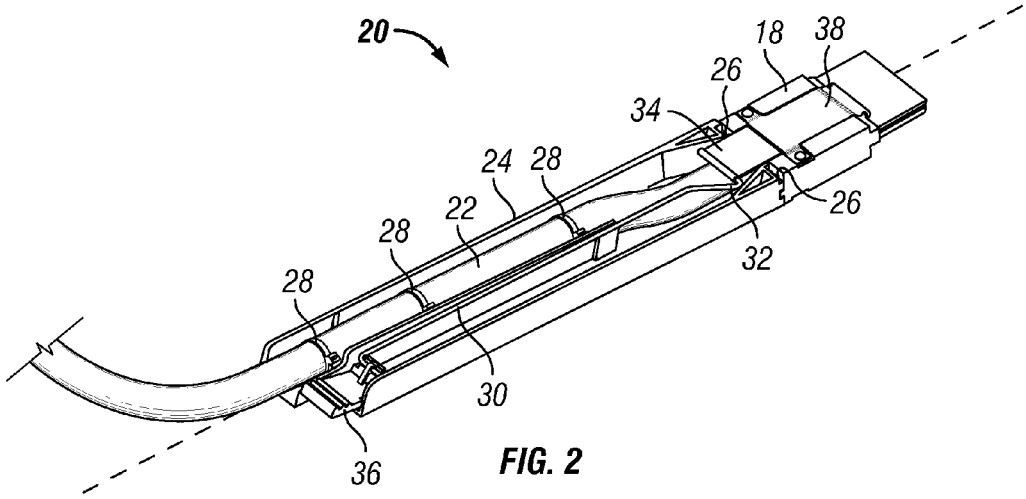
FIG. 2 is a perspective view of the cable trough securing a cable and cable connector plug.

FIG. 2 is a perspective view of the cable trough 20 securing a cable 22 and the cable connector plug 18. The cable trough 20 includes a rigid trough 24 having a distal end securing the cable connector plug 18 in axial alignment with the rigid trough 24. A pair of screws 26 is used to connect the cable connector plug 18 to the distal end of the rigid trough 24. The rigid trough 24 also has an elongate trough section extending between a proximal end and the distal end. The rigid trough 24 has a first side that receives the cable 22 from the center of the connector plug 18 at the distal end of the trough 24 and secures the cable 22 within the trough 24 as the cable extends to the proximal end of the trough 24. The cable is secured with common cable ties 28, but could also be secured in other ways known in the art. A second side of the rigid trough 24 has an elongate wire 30 passing there through. A distal end of the elongate wire 30 forms a hook 32 that is fastened to a pull tab 34 that extends under a connector latch element 38 forming part of the cable connector 18. A proximal end of the elongate wire 30 is coupled to a release lever 36. The release lever 36 is pivotally coupled to the trough 24 and extends rearward for accessible operation, such as by applying a downward force with a user's finger.

Figure 3:
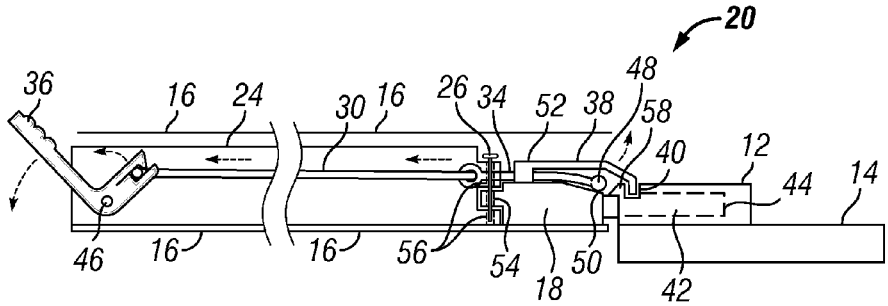
FIG. 3 is a schematic side view of the cable trough and cable connector with the connector latch in a closed position.

FIG. 3 is a schematic side view of the cable trough 20 coupled to the cable connector 18 with the connector latch element 38 in a closed position. The closed latch element 38 hooks a mating latch element 40 in a blind mate connector 12 on the motherboard 14. Latching of the elements 38, 40 is facilitated by the walls of the guide channel 16 vertically aligning the male coupling 42 of the cable connector plug 18 with the female coupling 44 of the blind mate connector 12. Although not shown in this figure, it should be recognized that the side walls of the guide channel 16 will serve to horizontally align the couplings 42, 44.

The release lever 36 is pivotally coupled to the tough 24 at a pivot point 46. Therefore, a downward force on the rearwardly extending arm of the lever 36 causes a generally axial displacement (in the rearward or proximal direction; left in FIG. 3) of the elongate wire 30. In turn, the axial displacement of the wire 30 pulls on the pull tab 34 which is coupled to an enlarged member 48. As the enlarged member 48 slides along the incline 50 in the body of the connector 18, the member 48 engages the latch element 38 are flexes the latch element 38 upward. The latch element 38 is rigidly coupled at the proximal end 52 and is preferably self-biased into the latched position. When there is no longer a downward force on the lever 36, the enlarged member 48 returns to its position and the latch element 38 returns to the latched position.

A pair of mounting holes 54 on the proximal end of the connector 18 on either side of the cable 22 (See FIG. 2) are aligned with mounting holes 56 on the distal end of the rigid trough 24 to enable the cable connector 18 to be secured with one or more pins or screws 26. Securing the cable connector 18 on both sides of the cable 22 with screws 26 (See FIG. 2) keeps the connector 18 is alignment with the trough 24.

Figure 4:
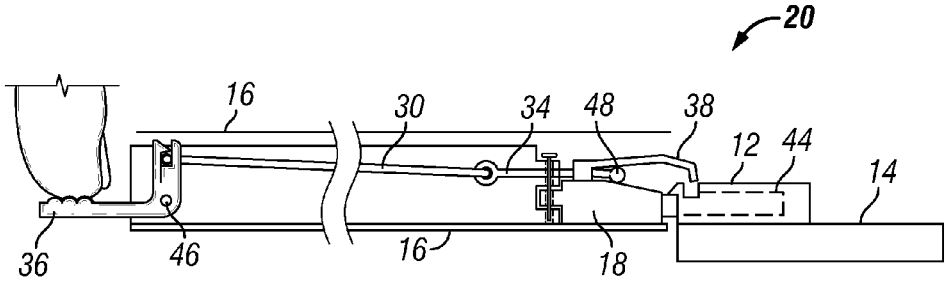
FIG. 4 is a schematic side view of the cable trough securing the cable and cable connector with the release lever actuated to open the connector latch.

FIG. 4 is a schematic side view of the cable trough 20 securing the cable and cable connector with the release lever 36 actuated to open the connector latch element 38. As shown, the release lever has pivoted about point 46, the elongate wire 30 has been displaced generally axially (although slightly transversely), the pull tab 34 has been pulled in the proximal direction by the same distance, and the enlarged member 48 has actuated and lifted the latch element 38 to the open position. This condition is necessary to release the connector 18 from the blind mate connector 12 and withdraw the cable trough 20 from the guide channel 16. Optionally, this condition may also be necessary to latch the connector 18 to the blind mate connector 12 after inserting the trough 20 into the guide channel 16. However, it is also possible for the latch element 38 to be self latching, such as by riding up on a sloped region 58 of the connector 12 when the latch element 38 approaches the latch element 40. (See also FIG. 3).

Figure 5:
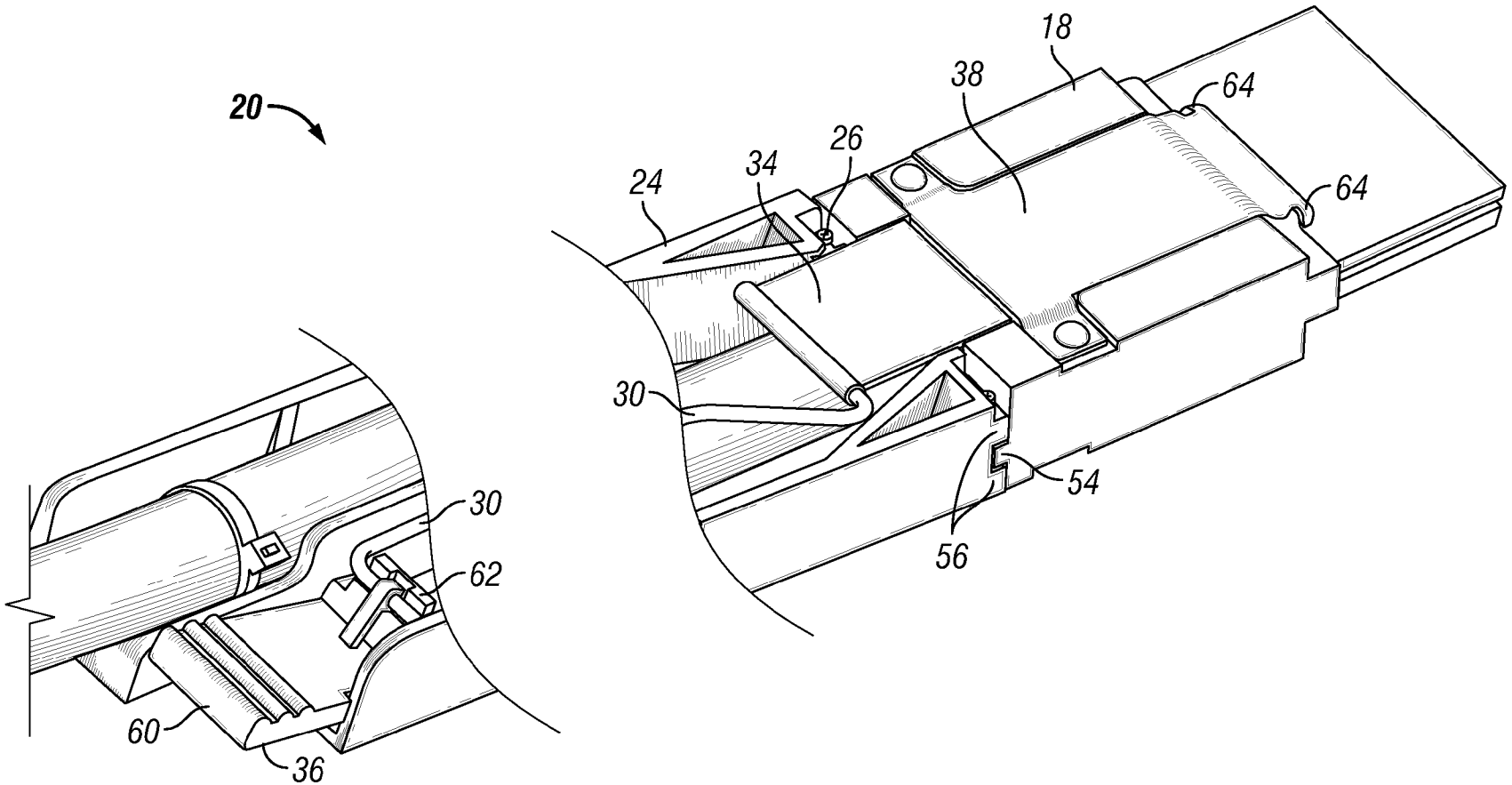
FIG. 5 is a perspective view of the proximal and distal ends of the cable trough.

FIG. 5 is a perspective view of the proximal and distal ends of the cable trough 20 showing greater detail of certain elements of one embodiment, including the release lever 36, the pull tab 34, and the latch element 38. The release lever 36 is formed as a "rocker arm" with a first accessible lever arm 60 and second arm 62 at generally right angles so that a downward force on the first arm 60 causes a generally axial force on the second arm 62. The second arm 62 pivotally secures the proximal end of the elongate wire 30. The hook 32 in the distal end of the wire 30 is securely or permanently coupled to the pull tab 34 which extends through a gap under the latch element 38. A pair of sharp latch hooks 64 is formed on the distal end of the latch element 38 for cooperating with latch elements in the blind mate connector (not shown). A partial cutaway section reveals the mounting holes 54, 56 that receive screw 26 for coupling the connector 18 to the distal end of the rigid trough 24. A similar connection is preferably included on the opposing side of the connector in alignment with the other screw 26.

The terms "comprising," "including," and "having," as used in the claims and specification herein, shall be considered as indicating an open group that may include other elements not specified. The terms "a," "an," and the singular forms of words shall be taken to include the plural form of the same words, such that the terms mean that one or more of something is provided. The term "one" or "single" may be used to indicate that one and only one of something is intended. Similarly, other specific integer values, such as "two," may be used when a specific number of things is intended. The terms "preferably," "preferred," "prefer," "optionally," "may," and similar terms are used to indicate that an item, condition or step being referred to is an optional (not required) feature of the invention.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A deep plug cable trough comprising:

a rigid trough securing a cable that terminates with a cable connector plug, wherein the cable connector plug has a connector latch operable with a pull tab for selectively latching the cable connector plug to a blind mate connector inside an electronic device, the trough having a distal end securing the cable connector plug in axial alignment with the trough, a proximal end, and an elongate trough section extending between the proximal and distal ends;

a release lever pivotally coupled to the proximal end of the trough; and an elongate wire extending within the trough and having a first end coupled to the release lever and a second end coupled to the pull tab;

wherein the rigid trough may be directed into a guide passage aligned with the blind mate connector for coupling and latching of the cable connector plug to the blind mate connector, and wherein the release lever is pivotally operable to pull the wire and actuate the pull tab to release the connector latch.

2. The cable trough of claim 1, wherein the release lever forms a rocker arm.

3. The cable trough of claim 1, wherein the release lever extends beyond a proximal end of the guide passage for accessible operability when the cable connector plug is latched to the blind mate connector.

4. The cable trough of claim 1, wherein trough secures the cable along a first side of the elongate trough section and the elongate wire extends along a second side of the elongate trough section.

5. The cable trough of claim 1, wherein cable connector plug is releasably secured to the distal end of the trough using a fastener.

6. The cable trough of claim 1, wherein the trough is substantially open to receive the cable and couple the wire to the pull tab.

7. The cable trough of claim 1, wherein the cable is a scalability cable.

8. An apparatus comprising:

a cable that terminates with a cable connector plug having a connector latch operable with a pull tab for selectively latching the cable connector plug to a blind mate connector inside an electronic device;

a rigid trough securing the cable, the trough having a distal end securing the cable connector plug in axial alignment with the trough, a proximal end, and an elongate trough section extending between the proximal and distal ends;

a release lever pivotally coupled to the proximal end of the trough; and an elongate wire extending within the trough and having a first end coupled to the release lever and a second end coupled to the pull tab;

wherein the rigid trough may be directed into a guide passage aligned with the blind mate connector for coupling and latching of the cable connector plug to the blind mate connector, and wherein the release lever is pivotally operable to pull the wire and actuate the pull tab to release the connector latch.

9. The apparatus of claim 8, wherein the release lever forms a rocker arm.

10. The apparatus of claim 8, wherein the release lever extends beyond a proximal end of the guide passage for accessible operability when the cable connector plug is latched to the blind mate connector.

11. The apparatus of claim 8, wherein trough secures the cable along a first side of the elongate trough section and the elongate wire extends along a second side of the elongate trough section.

12. The apparatus of claim 8, wherein cable connector plug is releasably secured to the distal end of the trough using a fastener.

13. The apparatus of claim 8, wherein the trough is substantially open to receive the cable and couple the wire to the pull tab.

14. The apparatus of claim 8, wherein the cable is a scalability cable.

* * * * *